US009290943B2

(12) United States Patent
Grubka et al.

(10) Patent No.: US 9,290,943 B2
(45) Date of Patent: Mar. 22, 2016

(54) HIP AND RIDGE ROOFING SHINGLE

(75) Inventors: Lawrence J. Grubka, Westerville, OH (US); Jennifer L. Frey, Monclova, OH (US); Hyun Gun Yu, Choen An-si Chung Nam (KR); Hun Song, Choen An-si Chung Nam (KR)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 13/344,025

(22) Filed: Jan. 5, 2012

(65) Prior Publication Data

US 2013/0177728 A1 Jul. 11, 2013

(51) Int. Cl.
*E04D 1/20* (2006.01)
*E04D 1/30* (2006.01)

(52) U.S. Cl.
CPC .. *E04D 1/20* (2013.01); *E04D 1/30* (2013.01); *E04D 2001/305* (2013.01); *Y10T 428/15* (2015.01)

(58) Field of Classification Search
CPC ..... E04D 1/00; E04D 1/02; E04D 1/20; E04D 1/26; E04D 1/30; E04D 5/00; E04D 5/02; E04D 5/12; E04D 2001/005; E04D 2001/304; E04D 2001/305; E04D 2001/3423; Y10T 428/15
USPC ..... 52/98–100, 518, 519, 532, 535, 543, 52/547, 555, 557–560, 415, 416, 419, 420, 52/DIG. 16; 428/43
See application file for complete search history.

(56) References Cited

U.S. PATENT DOCUMENTS

| | | | |
|---|---|---|---|
| 1,154,334 | A | 9/1915 | Overbury |
| D48,172 | S | 11/1915 | Dun Lany |
| 1,495,070 | A | 5/1924 | Finley |
| 1,516,243 | A | 11/1924 | Perry |
| 1,549,723 | A | 8/1925 | Mattison |
| 1,583,563 | A | 5/1926 | Abraham |
| 1,585,693 | A | 5/1926 | Robinson |
| 1,597,135 | A | 8/1926 | Wittenberg |
| 1,601,731 | A | 10/1926 | Flood |
| 1,665,222 | A | 4/1928 | Robinson |
| 1,666,429 | A | 4/1928 | Stolp, Jr. |

(Continued)

FOREIGN PATENT DOCUMENTS

| | | |
|---|---|---|
| CA | 1207975 | 7/1986 |
| JP | 50-002937 | 1/1975 |

(Continued)

OTHER PUBLICATIONS

International Search Report from PCT/US06/30633 dated Nov. 28, 2006.

(Continued)

*Primary Examiner* — Basil Katcheves
*Assistant Examiner* — Theodore Adamos
(74) *Attorney, Agent, or Firm* — Calfee, Halter & Griswold LLP

(57) ABSTRACT

A shingle blank includes a substrate coated with asphalt. A substantially V-shaped perforated cut line is formed in the substrate, and a substantially straight cut line extends from an apex the V-shaped perforated line toward a leading edge of the shingle blank. The V-shaped perforated cut line and the substantially straight cut line are structured and configured to facilitate separation of the shingle blank into discrete portions.

15 Claims, 5 Drawing Sheets

(56) References Cited

U.S. PATENT DOCUMENTS 1,676,351 A 7/1928 Robinson
1,698,891 A 1/1929 Overbury
1,701,926 A 2/1929 Kirschbraun
1,799,500 A 4/1931 Brophy
1,802,868 A 4/1931 Roscoe
1,843,370 A 2/1932 Overbury
1,885,346 A 11/1932 Harsherger
1,897,139 A 2/1933 Overbury
1,898,989 A 2/1933 Harshberger
2,058,167 A 10/1936 McQuade
2,161,440 A 6/1939 Venrick
2,490,430 A 12/1949 Greider et al.
2,798,006 A 7/1957 Oldfield et al.
2,847,948 A 8/1958 Truitt
3,127,701 A 4/1964 Jastrzemski
3,138,897 A 6/1964 McCorkle
3,252,257 A 5/1966 Price et al.
3,332,830 A 7/1967 Tomlinson et al.
3,377,762 A 4/1968 Chalmers
3,468,086 A 9/1969 Warner
3,468,092 A 9/1969 Chalmers
3,624,975 A 12/1971 Morgan et al.
3,664,081 A 5/1972 Martin et al.
3,813,280 A 5/1974 Olszyk et al.
3,913,294 A 10/1975 Freiborg
4,091,135 A 5/1978 Tajima et al.
4,194,335 A * 3/1980 Diamond ..... 52/419
4,195,461 A 4/1980 Thiis-Evensen
4,274,243 A 6/1981 Corbin et al.
4,301,633 A 11/1981 Neumann
4,307,552 A 12/1981 Votte
4,333,279 A 6/1982 Corbin et al.
4,352,837 A 10/1982 Kopenhaver
4,366,197 A 12/1982 Hanlon et al.
4,404,783 A 9/1983 Freiborg
4,434,589 A 3/1984 Freiborg
4,439,955 A 4/1984 Freiborg
4,459,157 A 7/1984 Koons
4,527,374 A 7/1985 Corbin
4,580,389 A 4/1986 Freiborg
4,637,191 A * 1/1987 Smith ..... 52/522
4,672,790 A 6/1987 Freiborg
4,680,909 A 7/1987 Stewart
4,706,435 A 11/1987 Stewart
4,717,614 A 1/1988 Bondoc et al.
4,738,884 A 4/1988 Algrim et al.
4,755,545 A 7/1988 Lalwani
4,789,066 A * 12/1988 Lisiecki ..... 229/123.2
D300,257 S 3/1989 Stahl
4,817,358 A 4/1989 Lincoln et al.
4,824,880 A 4/1989 Algrim et al.
4,835,929 A 6/1989 Bondoc et al.
4,848,057 A 7/1989 MacDonald et al.
4,856,251 A * 8/1989 Buck ..... 52/553
4,869,942 A 9/1989 Jennus et al.
D309,027 S 7/1990 Noone et al.
D313,278 S 12/1990 Noone
5,036,119 A 7/1991 Berggren
5,065,553 A 11/1991 Magid
5,094,042 A 3/1992 Freborg
5,181,361 A 1/1993 Hannah et al.
5,195,290 A 3/1993 Hulett
5,209,802 A 5/1993 Hannah et al.
5,232,530 A 8/1993 Malmquist et al.
5,239,802 A 8/1993 Robinson
5,247,771 A 9/1993 Poplin
D340,294 S 10/1993 Hannah et al.
5,271,201 A 12/1993 Noone et al.
5,295,340 A 3/1994 Collins
D347,900 S 6/1994 Stapleton
5,319,898 A 6/1994 Freiborg
5,365,711 A 11/1994 Pressutti et al.
5,369,929 A 12/1994 Weaver et al.
5,375,387 A 12/1994 Davenport
5,375,388 A 12/1994 Poplin
5,400,558 A 3/1995 Hannah et al.
5,419,941 A 5/1995 Noone et al.
5,426,902 A 6/1995 Stahl et al.
5,467,568 A 11/1995 Sieling
5,471,801 A 12/1995 Kupczyk et al.
D366,124 S 1/1996 Hannah et al.
5,488,807 A 2/1996 Terrenzio et al.
D369,421 S 4/1996 Kiik et al.
D375,563 S 11/1996 Hannah et al.
5,570,556 A 11/1996 Wagner
5,571,596 A 11/1996 Johnson
5,575,876 A 11/1996 Noone et al.
5,577,361 A 11/1996 Grabek, Jr.
D376,660 S 12/1996 Hannah et al.
5,611,186 A 3/1997 Weaver
5,615,523 A 4/1997 Wells et al.
5,624,522 A 4/1997 Belt et al.
D379,672 S 6/1997 Lamb et al.
5,651,734 A 7/1997 Morris
5,660,014 A 8/1997 Stahl et al.
D383,223 S * 9/1997 Sieling et al. ..... D25/142
5,664,385 A 9/1997 Koschitzky
5,666,776 A 9/1997 Weaver et al.
5,676,597 A 10/1997 Bettoli et al.
5,711,126 A 1/1998 Wells et al.
5,746,830 A 5/1998 Burton
5,795,389 A 8/1998 Koschitzky
5,799,459 A * 9/1998 Covert ..... 52/518
D400,268 S 10/1998 Sieling et al.
5,822,943 A 10/1998 Frankoski et al.
D400,981 S 11/1998 Bondoc et al.
D403,087 S 12/1998 Seiling et al.
5,853,858 A 12/1998 Bondoc
5,860,263 A 1/1999 Sieling et al.
D406,361 S 3/1999 Bondoc et al.
5,901,517 A 5/1999 Stahl et al.
5,916,103 A 6/1999 Roberts
5,939,169 A 8/1999 Bondoc et al.
5,950,387 A 9/1999 Stahl et al.
D417,016 S 11/1999 Moore et al.
D417,513 S 12/1999 Blampied
6,010,589 A 1/2000 Stahl et al.
6,014,847 A 1/2000 Phillips
6,021,611 A * 2/2000 Wells et al. ..... 52/98
6,038,826 A 3/2000 Stahl et al.
6,044,608 A 4/2000 Stahl et al.
6,070,384 A 6/2000 Chich
6,083,592 A 7/2000 Chich
6,105,329 A 8/2000 Bondoc et al.
RE36,858 E 9/2000 Pressutti et al.
6,112,492 A * 9/2000 Wells et al. ..... 52/558
6,125,602 A 10/2000 Freiborg et al.
6,145,265 A 11/2000 Malarkey et al.
6,148,578 A 11/2000 Nowacek et al.
6,156,289 A * 12/2000 Chopra et al. ..... 423/633
6,182,400 B1 2/2001 Freiborg et al.
6,185,895 B1 2/2001 Rettew
6,190,754 B1 2/2001 Bondoc et al.
6,199,338 B1 * 3/2001 Hudson et al. ..... 52/518
6,220,329 B1 4/2001 King et al.
6,247,289 B1 6/2001 Karpinia
6,253,512 B1 7/2001 Thompson et al.
6,310,122 B1 10/2001 Butler et al.
6,343,447 B2 2/2002 Geissels et al.
6,351,913 B1 3/2002 Freiborg et al.
6,355,132 B1 3/2002 Becker et al.
6,361,851 B1 3/2002 Sieling et al.
6,397,546 B1 6/2002 Malarkey et al.
6,397,556 B1 6/2002 Karpinia
6,401,425 B1 6/2002 Frame
6,426,309 B1 7/2002 Miller et al.
6,467,235 B2 10/2002 Kalkanoglu et al.
6,471,812 B1 10/2002 Thompson et al.
D466,629 S 12/2002 Phillips
6,487,828 B1 12/2002 Phillips
6,494,010 B1 12/2002 Brandon et al.
6,510,664 B2 1/2003 Kupczyk
6,523,316 B2 2/2003 Stahl et al.
6,530,189 B2 * 3/2003 Freshwater et al. ..... 52/553

(56) References Cited

U.S. PATENT DOCUMENTS

| | | | | |
|---|---|---|---|---|
| D473,326 | S | 4/2003 | Phillips | |
| 6,565,431 | B1 | 5/2003 | Villela | |
| 6,578,336 | B2 | 6/2003 | Elliott | |
| 6,610,147 | B2 | 8/2003 | Aschenbeck | |
| 6,652,909 | B2 | 11/2003 | Lassiter | |
| 6,679,020 | B2 | 1/2004 | Becker et al. | |
| 6,679,308 | B2 | 1/2004 | Becker et al. | |
| 6,691,489 | B2 | 2/2004 | Frame | |
| 6,708,456 | B2 | 3/2004 | Kiik et al. | |
| 6,709,760 | B2 | 3/2004 | Trumbore et al. | |
| 6,709,994 | B2 | 3/2004 | Miller et al. | |
| 6,725,609 | B2 * | 4/2004 | Freiborg et al. | 52/57 |
| 6,758,019 | B2 | 7/2004 | Kalkanoglu et al. | |
| 6,759,454 | B2 | 7/2004 | Stephens et al. | |
| 6,790,307 | B2 | 9/2004 | Elliott | |
| 6,804,919 | B2 | 10/2004 | Raikar | |
| 6,813,866 | B2 | 11/2004 | Naipawer, III | |
| 6,823,637 | B2 | 11/2004 | Elliott et al. | |
| 6,895,724 | B2 | 5/2005 | Naipawer, III | |
| 6,933,037 | B2 | 8/2005 | McCumber et al. | |
| 6,936,329 | B2 | 8/2005 | Kiik et al. | |
| 6,990,779 | B2 | 1/2006 | Kiik et al. | |
| 7,021,468 | B2 * | 4/2006 | Cargile, Jr. | 206/746 |
| 7,029,739 | B2 | 4/2006 | Weinstein et al. | |
| 7,048,990 | B2 | 5/2006 | Koschitzky | |
| 7,070,051 | B2 | 7/2006 | Kanner et al. | |
| 7,073,295 | B2 | 7/2006 | Pressutti et al. | |
| 7,082,724 | B2 | 8/2006 | Raikar et al. | |
| 7,118,794 | B2 | 10/2006 | Kalkanoglu et al. | |
| 7,121,055 | B2 | 10/2006 | Penner | |
| 7,124,548 | B2 | 10/2006 | Pressutti et al. | |
| 7,146,771 | B2 | 12/2006 | Swann | |
| 7,165,363 | B2 * | 1/2007 | Headrick et al. | 52/198 |
| 7,238,408 | B2 | 7/2007 | Aschenbeck et al. | |
| 7,267,862 | B1 | 9/2007 | Burke et al. | |
| 7,282,536 | B2 | 10/2007 | Handlin et al. | |
| 7,556,849 | B2 | 7/2009 | Thompson et al. | |
| D610,720 | S | 2/2010 | Elliott | |
| 7,765,763 | B2 | 8/2010 | Teng et al. | |
| 7,781,046 | B2 | 8/2010 | Kalkanoglu et al. | |
| 7,805,905 | B2 | 10/2010 | Rodrigues et al. | |
| 7,820,237 | B2 | 10/2010 | Harrington, Jr. | |
| 7,836,654 | B2 | 11/2010 | Belt et al. | |
| 7,877,949 | B1 | 2/2011 | Elliott | |
| 7,909,235 | B2 * | 3/2011 | Holley, Jr. | 229/122 |
| 7,921,606 | B2 | 4/2011 | Quaranta et al. | |
| 8,006,457 | B2 | 8/2011 | Binkley et al. | |
| 8,127,514 | B2 | 3/2012 | Binkley et al. | |
| 8,181,413 | B2 | 5/2012 | Belt et al. | |
| 8,216,407 | B2 | 7/2012 | Kalkanoglu et al. | |
| 8,240,102 | B2 | 8/2012 | Belt et al. | |
| 8,266,861 | B2 | 9/2012 | Koch et al. | |
| 8,281,520 | B2 | 10/2012 | Quaranta et al. | |
| 8,281,539 | B2 | 10/2012 | Kalkanoglu | |
| 8,302,358 | B2 | 11/2012 | Kalkanoglu | |
| 8,316,608 | B2 | 11/2012 | Binkley et al. | |
| 8,323,440 | B2 | 12/2012 | Koch et al. | |
| 8,371,072 | B1 | 2/2013 | Shanes et al. | |
| 8,371,085 | B2 | 2/2013 | Koch | |
| 8,453,408 | B2 | 6/2013 | Kalkanoglu | |
| 2001/0000372 | A1 | 4/2001 | Kalkanoglu et al. | |
| 2001/0049002 | A1 | 12/2001 | McCumber et al. | |
| 2002/0000068 | A1 * | 1/2002 | Freiborg et al. | 52/57 |
| 2002/0038531 | A1 * | 4/2002 | Freshwater et al. | 52/518 |
| 2002/0078651 | A1 | 6/2002 | Freshwater et al. | |
| 2002/0114913 | A1 | 8/2002 | Weinstein et al. | |
| 2003/0040241 | A1 | 2/2003 | Kiik et al. | |
| 2003/0070579 | A1 | 4/2003 | Hong et al. | |
| 2003/0093958 | A1 | 5/2003 | Freiborg et al. | |
| 2003/0093963 | A1 | 5/2003 | Stahl et al. | |
| 2003/0124292 | A1 | 7/2003 | Unterreiter | |
| 2003/0138601 | A1 | 7/2003 | Elliott | |
| 2004/0055240 | A1 | 3/2004 | Kiik et al. | |
| 2004/0055241 | A1 | 3/2004 | Raikar | |
| 2004/0079042 | A1 | 4/2004 | Elliott | |
| 2004/0083672 | A1 | 5/2004 | Penner | |
| 2004/0083673 | A1 | 5/2004 | Kalkanoglu et al. | |
| 2004/0083674 | A1 | 5/2004 | Kalkanoglu et al. | |
| 2004/0109971 | A1 | 6/2004 | Weinstein et al. | |
| 2004/0111996 | A1 | 6/2004 | Heroneme | |
| 2004/0123537 | A1 | 7/2004 | Elliott et al. | |
| 2004/0123543 | A1 | 7/2004 | Elliott et al. | |
| 2004/0148874 | A1 | 8/2004 | Jolitz et al. | |
| 2004/0172908 | A1 | 9/2004 | Swann | |
| 2004/0206012 | A1 | 10/2004 | Pressutti et al. | |
| 2004/0206035 | A1 * | 10/2004 | Kandalgaonkar | 52/551 |
| 2004/0258883 | A1 | 12/2004 | Weaver | |
| 2005/0005555 | A1 | 1/2005 | Naipawar | |
| 2005/0137295 | A1 | 6/2005 | Kendrick et al. | |
| 2005/0193673 | A1 | 9/2005 | Rodrigues et al. | |
| 2005/0204675 | A1 * | 9/2005 | Snyder et al. | 52/555 |
| 2005/0210808 | A1 | 9/2005 | Larson et al. | |
| 2005/0235599 | A1 | 10/2005 | Kalkanoglu et al. | |
| 2005/0252136 | A1 | 11/2005 | Hardin | |
| 2006/0032174 | A1 | 2/2006 | Floyd | |
| 2006/0175386 | A1 * | 8/2006 | Holley, Jr. | 229/122 |
| 2006/0179767 | A1 | 8/2006 | Miller et al. | |
| 2006/0201094 | A1 | 9/2006 | Lassiter | |
| 2006/0265990 | A1 | 11/2006 | Kalkanoglu et al. | |
| 2007/0020436 | A1 | 1/2007 | Teng et al. | |
| 2007/0039274 | A1 | 2/2007 | Harrington et al. | |
| 2007/0042158 | A1 | 2/2007 | Belt et al. | |
| 2007/0107372 | A1 | 5/2007 | Harrington, Jr. | |
| 2007/0144077 | A1 | 6/2007 | Quaranta et al. | |
| 2007/0179220 | A1 | 8/2007 | Sasagawa et al. | |
| 2007/0266665 | A1 | 11/2007 | Todd et al. | |
| 2008/0134612 | A1 | 6/2008 | Koschitzky | |
| 2009/0038257 | A1 | 2/2009 | Todd et al. | |
| 2009/0139175 | A1 * | 6/2009 | Todd et al. | 52/557 |
| 2009/0282767 | A1 * | 11/2009 | Grubka | 52/518 |
| 2010/0077689 | A1 | 4/2010 | Kalkanoglu et al. | |
| 2010/0143667 | A1 | 6/2010 | Collins et al. | |
| 2010/0192496 | A1 | 8/2010 | Koch et al. | |
| 2010/0192500 | A1 | 8/2010 | Koch | |
| 2010/0212240 | A1 | 8/2010 | Grubka | |
| 2010/0212246 | A1 | 8/2010 | Grubka | |
| 2010/0218433 | A1 | 9/2010 | Quaranta et al. | |
| 2010/0236178 | A1 | 9/2010 | Loftus | |
| 2010/0239807 | A1 | 9/2010 | Grubka | |
| 2010/0310825 | A1 | 12/2010 | Kalkanoglu et al. | |
| 2010/0313512 | A1 | 12/2010 | Rodrigues et al. | |
| 2011/0005158 | A1 | 1/2011 | Kailey et al. | |
| 2011/0126485 | A1 | 6/2011 | Bleil et al. | |
| 2011/0151170 | A1 | 6/2011 | Grubka et al. | |
| 2011/0209428 | A1 | 9/2011 | Elliott | |
| 2011/0214378 | A1 | 9/2011 | Grubka | |
| 2011/0319533 | A1 | 12/2011 | Gauthier et al. | |
| 2013/0177728 | A1 | 7/2013 | Grubka et al. | |

FOREIGN PATENT DOCUMENTS

| | | |
|---|---|---|
| WO | 2005/100479 | 10/2005 |
| WO | 2007/108846 | 9/2007 |
| WO | 2008/052029 | 5/2008 |
| WO | 2009/016281 | 2/2009 |
| WO | 2010/098972 | 9/2010 |
| WO | 2011/100217 | 8/2011 |

OTHER PUBLICATIONS

International Search Report and Written Opinion from PCT/US07/07827 dated Aug. 29, 2007.
International Search Report and Written Opinion from PCT/US10/23541 dated Jul. 6, 2010.
International Search Report and Written Opinion from PCT/US11/023989 dated May 26, 2011.
Office action from U.S. Appl. No. 09/515,928 dated Mar. 15, 2001.
Office action from U.S. Appl. No. 09/515,928 dated Oct. 11, 2001.
Office action from U.S. Appl. No. 09/515,928 dated Jan. 2, 2002.
Advisory action from U.S. Appl. No. 09/515,928 dated Jun. 7, 2002.
Office action from U.S. Appl. No. 09/515,928 dated Sep. 16, 2004.
Advisory action from U.S. Appl. No. 09/515,928 dated Feb. 22, 2005.
Office action from U.S. Appl. No. 09/515,928 dated Dec. 2, 2005.

(56) References Cited

OTHER PUBLICATIONS

Office action from U.S. Appl. No. 09/515,928 dated Apr. 25, 2006.
Office action from U.S. Appl. No. 09/515,928 dated Oct. 11, 2006.
Advisory action from U.S. Appl. No. 09/515,928 dated Jul. 19, 2007.
Office action from U.S. Appl. No. 09/515,928 dated Sep. 19, 2007.
Notice of Panel Decision from Pre-Appeal Brief Review from U.S. Appl. No. 09/515,928 dated Feb. 8, 2008.
Examiner's Answer from U.S. Appl. No. 09/515,928 dated Jun. 18, 2008.
Decision on Appeal from U.S. Appl. No. 09/515,928 dated Jul. 28, 2010.
Notice of Allowance from U.S. Appl. No. 09/515,928 dated Sep. 27, 2010.
Office action from U.S. Appl. No. 12/119,937 dated Apr. 14, 2010.
Office action from U.S. Appl. No. 12/119,937 dated Nov. 4, 2010.
Advisory action from U.S. Appl. No. 12/119,937 dated Jan. 19, 2011.
Office action from U.S. Appl. No. 12/119,937 dated Apr. 3, 2012.
Office action from U.S. Appl. No. 12/392,392 dated Mar. 4, 2010.
Office action from U.S. Appl. No. 12/392,392 dated Sep. 13, 2010.
Advisory Action from U.S. Appl. No. 12/392,392 dated Dec. 14, 2010.
Office action from U.S. Appl. No. 12/392,392 dated Dec. 22, 2010.
Interview Summary from U.S. Appl. No. 12/392,392 dated Feb. 3, 2011.
Office action from U.S. Appl. No. 12/392,392 dated Aug. 18, 2011.
Office action from U.S. Appl. No. 12/392,392 dated Nov. 21, 2011.
Advisory Action from U.S. Appl. No. 12/392,392 dated Feb. 27, 2012.
Office action from U.S. Appl. No. 12/392,392 dated Jun. 14, 2012.
Office action from U.S. Appl. No. 12/392,392 dated Jul. 19, 2012.
Office action from U.S. Appl. No. 12/702,457 dated Jun. 18, 2012.
Office action from U.S. Appl. No. 12/702,457 dated Jul. 20, 2012.
Office action from U.S. Appl. No. 12/717,519 dated Oct. 3, 2011.
Office action from U.S. Appl. No. 12/717,519 dated May 1, 2012.
Office action from U.S. Appl. No. 12/727,459 dated May 25, 2011.
Office action from U.S. Appl. No. 12/727,459 dated Aug. 30, 2011.
Interview Summary from U.S. Appl. No. 12/727,459 dated Dec. 28, 2011.
Office action from U.S. Appl. No. 12/727,459 dated Jan. 19, 2012.
Interview Summary from U.S. Appl. No. 12/727,459 dated Apr. 13, 2012.
Office action from U.S. Appl. No. 12/727,459 dated May 30, 2012.
Office action from U.S. Appl. No. 12/727,459 dated Oct. 3, 2012.
Office action from U.S. Appl. No. 12/727,470 dated Aug. 10, 2012.
Office action from U.S. Appl. No. 12/831,130 dated Feb. 29, 2012.
Office action from U.S. Appl. No. 12/831,130 dated Jun. 14, 2012.
Office action from U.S. Appl. No. 12/831,130 dated Aug. 9, 2012.
Office action from U.S. Appl. No. 13/019,028 dated Aug. 10, 2011.
Office action from U.S. Appl. No. 13/019,028 dated Jun. 21, 2012.
Office action from Chinese application No. 200680028893.4 dated Apr. 24, 2009.
Office action from Japanese Application No. 2008-525265 dated Dec. 12, 2011.
Office action from U.S. Appl. No. 13/019,028 dated Dec. 19, 2012.
Advisory Action from U.S. Appl. No. 12/727,459 dated Dec. 13, 2012.
Office action from U.S. Appl. No. 12/727,470 dated Apr. 10, 2013.
Office action from U.S. Appl. No. 12/727,459 dated Jul. 11, 2013.
Office action from U.S. Appl. No. 13/193,864 dated Nov. 4, 2013, 20 pgs.
Office action from U.S. Appl. No. 13/193,864 dated May 15, 2013, 25 pgs. originally submitted on Jun. 26, 2013 resubmitted herewith in accordance with request from Examining Attorney in Office action of Aug. 16, 2013.
Office action from U.S. Appl. No. 12/702,457, filed Nov. 21, 2013.
Office action from U.S. Appl. No. 12/727,459 dated Jan. 10, 2014.
Office action from U.S. Appl. No. 13/039,726 dated Feb. 5, 2014.
Haynes, Shellflex 3681 MSDS, Jan. 4, 1999, 5 pgs.
Office action from U.S. Appl. No. 12/717,519 dated Jun. 12, 2014.
Office action from U.S. Appl. No. 12/727,459 dated Jun. 6, 2014.
Office action from U.S. Appl. No. 12/702,457 dated May 7, 2014.
Interview Summary from U.S. Appl. No. 12/702,457 dated Feb. 26, 2014.
Office action from U.S. Appl. No. 12/702,457 dated Dec. 3, 2014.
Interview Summary from U.S. Appl. No. 12/727,459 dated Aug. 19, 2014.
Interview Summary from U.S. Appl. No. 12/702,457 dated Jul. 31, 2014.
Advisory Action from U.S. Appl. No. 12/702,457 dated Aug. 27, 2014.
Office action from U.S. Appl. No. 13/039,726 dated Aug. 14, 2014.
Notice of Allowance from U.S. Appl. No. 13/029,726 dated Jan. 22, 2015.
Office action from U.S. Appl. No. 12/727,459 dated Jan. 26, 2015.
Interview Summary from U.S. Appl. No. 12/702,457 dated Mar. 4, 2015.
Notice of Allowance from U.S. Appl. No. 12/702,457 dated May 26, 2015.
Office action from U.S. Appl. No. 12/727,470 dated May 26, 2015.
Advisory Action from U.S. Appl. No. 13/039,726 dated Oct. 28, 2014.
Office action from U.S. Appl. No. 12/717,519 dated Dec. 12, 2014.
Notice of Allowance from U.S. Appl. No. 12/717,519 dated Apr. 2, 2015.
Office action from Canadian Application No. 2,697,223 dated Jan. 12, 2016.

* cited by examiner

HIP AND RIDGE ROOFING SHINGLE

BACKGROUND OF THE INVENTION

Asphalt-based roofing materials, such as roofing shingles, roll roofing, and commercial roofing are installed on the roofs of buildings to provide protection from the elements. The roofing material may be constructed of a substrate such as a glass fiber mat or an organic felt, an asphalt coating on the substrate, and a surface layer of granules embedded in the asphalt coating.

Roofing materials are applied to roofs having various surfaces formed by roofing planes. The various surfaces and roofing planes form intersections, such as for example hips and ridges. A ridge is the uppermost generally horizontal intersection of two sloping roof planes. Hips are formed by the intersection of two sloping roof planes running from a ridge to the eaves.

The above notwithstanding, there remains a need in the art for improved hip and ridge roofing shingles and an improved method of manufacturing hip and ridge roofing shingles.

SUMMARY OF THE INVENTION

The present application describes various embodiments of a shingle blank from which multiple hip and ridge roofing shingles may be separated by perforations and/or cuts. One embodiment of the shingle blank includes a substrate coated with asphalt. A substantially V-shaped perforated cut line is formed in the substrate, and a substantially straight cut line extends from an apex of the V-shaped perforated line toward a leading edge of the shingle blank. The V-shaped perforated cut line and the substantially straight cut line are structured and configured to facilitate separation of the shingle blank into discrete portions.

Another embodiment of the shingle blank includes a substrate coated with asphalt. A notch is formed in the substrate, and a perforated cut line extends from the notch toward a leading edge of the shingle blank. The notch and the perforated cut line are structured and configured to facilitate separation of the shingle blank into discrete portions.

An additional embodiment of the shingle blank includes a substrate coated with asphalt. First cut lines are formed in the substrate and define a notch. A second cut line extends from the notch toward a leading edge of the shingle blank. The notch and the second cut line are structured and configured to facilitate separation of the shingle blank into discrete portions. Other advantages of the shingle blank will become apparent to those skilled in the art from the following detailed description, when read in view of the accompanying drawings.

DETAILED DESCRIPTION OF THE INVENTION

The present invention will now be described with occasional reference to the illustrated embodiments of the invention. This invention may, however, be embodied in different forms and should not be construed as limited to the embodiments set forth herein, nor in any order of preference. Rather, these embodiments are provided so that this disclosure will be more thorough, and will convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
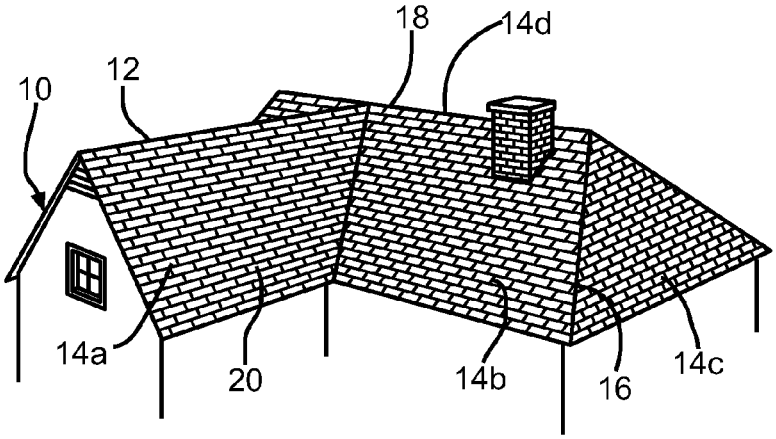
FIG. 1 is a perspective view of a building structure incorporating the hip and ridge roofing shingles in accordance with this invention.

The description and drawings disclose a hip and ridge roofing shingles for a roofing system. With reference to FIG. 1, a building structure 10 is shown having a shingle-based roofing system 12. While the building structure 10 illustrated in FIG. 1 is a residential home, it will be understood that the building structure 10 may be any type of structure, such as a garage, church, arena, or commercial building having a shingle-based roofing system 12.

The building structure 10 has a plurality of roof planes 14*a* through 14*d*. The term "roof plane" as used herein is defined as a plane or flat portion of the roof formed by an area of roof deck. Each of the roof planes 14*a* through 14*d* has a slope. The term "slope" as used herein is defined as the degree of incline of the roof plane. While the roof planes 14*a* through 14*d* shown in FIG. 1 have their respective illustrated slopes, it will be understood that the roof planes 14*a* through 14*d* may have any suitable slope. The term "hip" as used herein is defined as the inclined external angle formed by the intersection of two sloping roof planes. For example, the intersection of the roof planes 14*b* and 14*c* form a hip 16. The term "ridge" as used herein is defined as the uppermost horizontal external angle formed by the intersection of two sloping roof planes. For example, the intersection of the roof planes 14*b* and 14*d* form a ridge 18.

Figure 2:
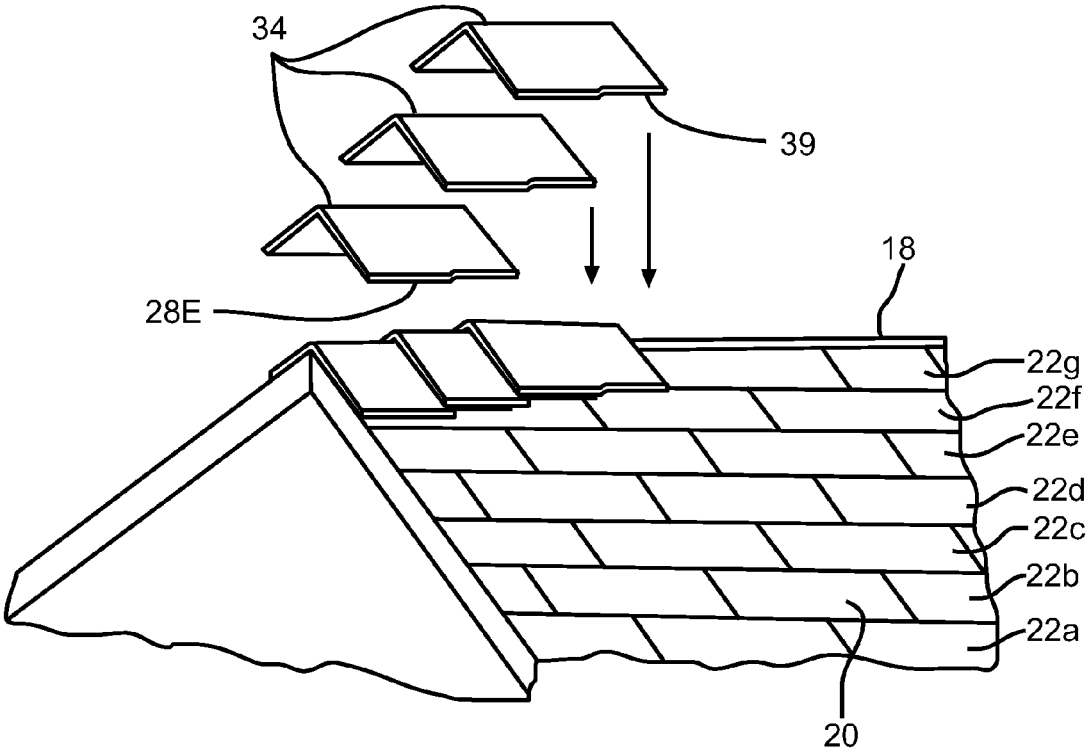
FIG. 2 is a perspective view of the installation of the hip and ridge roofing shingles illustrated in FIG. 1.

The building structure 10 is covered by the roofing system 12 having a plurality of shingles 20. In the illustrated embodiment, the shingles 20 are a storm proof, asphalt-based roofing material of the type disclosed in commonly assigned U.S. Pat. No. 6,709,994 to Miller et al., which is incorporated by reference, in its entirety. As shown in FIG. 2, the shingles 20 are installed on the various roof decks in generally horizontal courses 22*a* through 22*g* in which the shingles 20 overlap the shingles of a preceding course. While the shingles 20 shown in FIG. 2 are of a storm proof design, it will be understood that any suitable shingle may be used.

Hip and ridge roofing shingles are installed to protect hips 16 and ridges 18 from the elements. As shown in FIG. 2, hip and ridge roofing shingles 34 are installed on the ridge 18 and over the shingles 20. In a similar fashion, although not shown in FIG. 2, hip and ridge roofing shingles 34 are also installed on a hip 16 and over the shingles 20. The method of installing the hip and ridge roofing shingles 34 will be discussed in more detail below.

Figure 3:
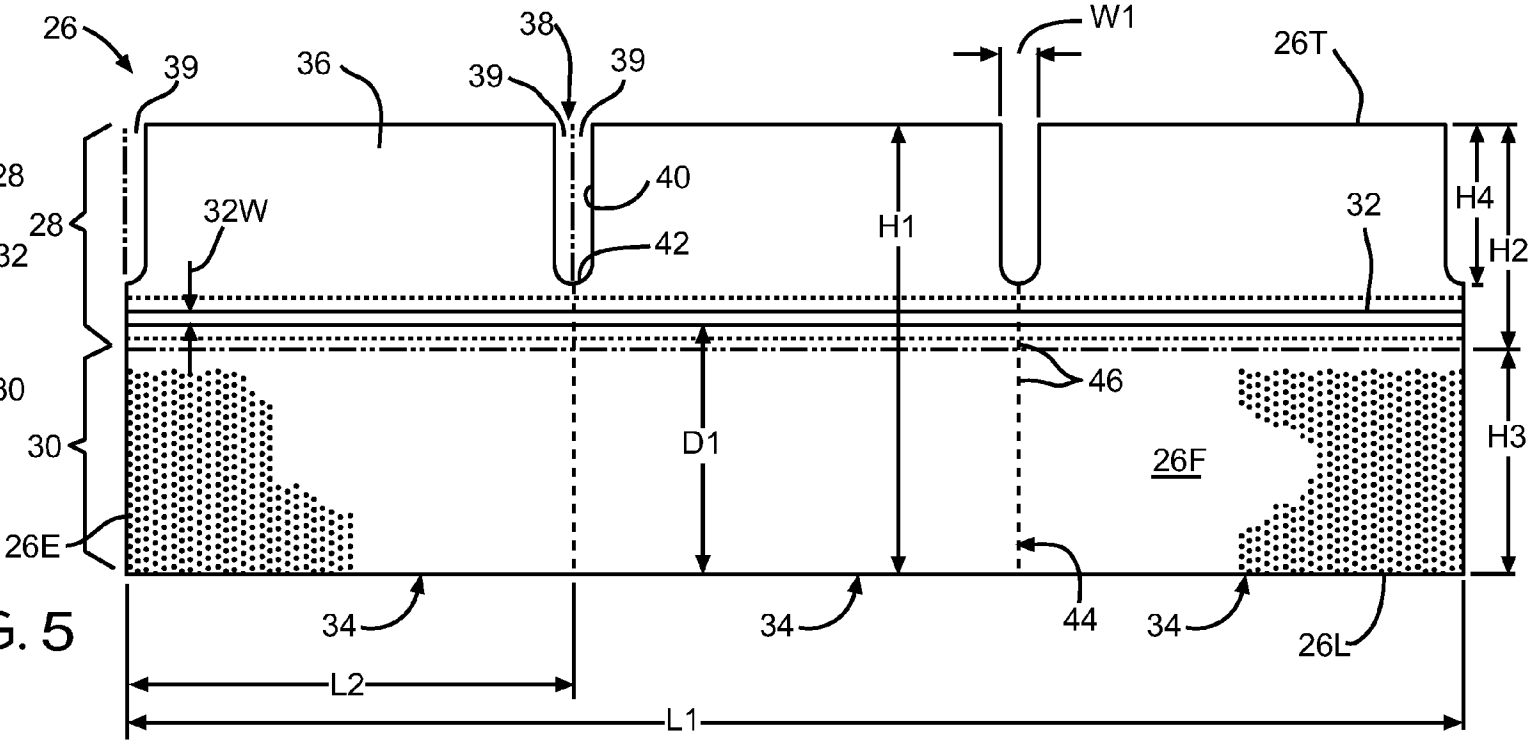
FIG. 3 is a top plan view of a first embodiment of a shingle blank in accordance with this invention.

Referring now to FIG. 3, a front side 26F of a first embodiment of a shingle blank 26 from which multiple hip and ridge roofing shingles 34 may be separated by perforations and/or cuts is illustrated. The illustrated shingle blank 26 includes a headlap region 28 and a prime region 30. The headlap region 28 of the shingle blank 26 is the portion of each hip and ridge roofing shingle 34 that is covered by an overlapping hip and ridge roofing shingle 34 when the hip and ridge roofing shingles 34 are installed on a roof. The prime region 30 of the shingle blank 26 is the portion of each hip and ridge roofing shingle 34 that remains exposed when the hip and ridge roofing shingles 34 are installed on a roof.

In the illustrated embodiment, a bead of tab sealant 32 extends longitudinally on the front side 26F of the shingle blank 26. The tab sealant 32 may be spaced a distance D1 from the leading edge 26L of the shingle blank 26. In the illustrated embodiment, the tab sealant 32 is spaced about 6.8 inches (17.27 cm) from the leading edge 26L of the shingle blank 26. It will be understood that the distance D1 that the tab sealant 32 may be spaced from the leading edge 26L of the shingle blank 26 will vary based on the amount of prime region 30 of the shingle blank 26 that will be exposed on the roof. In FIG. 3, the prime region 30 has a height H3 of about 6.0 inches (15.24 cm), thus about 6.0 inches (15.24 cm) of the prime region 30 will be exposed on the roof. The distance D1 may therefore be other than about 6.8 inches (17.27 cm) when the height H3 of the prime region 30 is other than 6.0 inches (15.24 cm), such as about 5.0 inches (12.70 cm) or about 8.0 inches (20.32 cm).

The bead of tab sealant 32 has a width 32W. In the illustrated embodiment, the bead of tab sealant 32 has a width 32W of about 0.5 inch (1.27 cm). Alternatively, the bead of tab sealant 32 may have a width 32W within the range of from about 0.375 inches (0.95 cm) to about 0.675 inches (1.71 cm). The bead of tab sealant 32 may also be applied having any other desired width. In the illustrated embodiment, the bead of tab sealant 32 has a thickness of about 0.035 inch (0.09 cm). Alternatively, the bead of tab sealant 32 may have a thickness within the range of from about 0.028 inches (0.07 cm) to about 0.050 inches (0.127 cm). The bead of tab sealant 32 may also be applied having any other desired thickness.

In the illustrated embodiment, the tab sealant 32 is applied as a continuous bead. Alternatively, the tab sealant may be applied as a discontinuous bead having segments of predetermined lengths as disclosed in commonly assigned U.S. patent application Ser. No. 13/193,864, filed Jul. 29, 2011 the description therein of continuous and discontinuous tab sealants is incorporated herein by reference.

If desired, a continuous strip of release tape 33 may extend longitudinally and may be adhered to the back side 26B of the shingle blank 26. The release tape 33 is positioned such that it will be opposite the tab sealant 32 when the shingle blanks 26 are stacked, such as when packaged for shipment. The release tape 33 may be placed at any desired location on the back side 26B of the shingle blank 26, such that the release tape 33 contacts and covers the tab sealant 32 when a plurality of the shingle blanks 26 are stacked in a bundle, such as for shipping. It will be understood that if desired, the bead of tab sealant 32 may be applied to the back side 26B of the shingle blank 26, rather than the front side 26F of the shingle blank 26, and the strip of release tape 33 may be adhered to the front side 26F rather than the back side 26B of the shingle blank 26.

The shingle blank 26 may have any suitable dimensions. The shingle blank 26 may also be divided between the headlap region 28 and the prime region 30 in any suitable proportion. For example, illustrated shingle blank 26 has a length L1 of about 36 inches (91.5 cm) and a height H1 of about 12 inches (30.5 cm). Alternatively, the shingle blank 26 may have a length L1 within the range of from about 24.0 inches (60.96 cm) to about 39⅜ inches (100.01 cm), and a height H1 within the range of from about 7.0 inches (17.78 cm) to about 14.0 inches (35.56 cm). The height H1 dimension is divided between the height H2 of the headlap region 28 and the height H3 of the prime region 30. In the illustrated embodiment, the height H2 of the headlap region 28 and the height H3 of the prime region 30 are both about 6.0 inches (15.24 cm). Alternatively, the height H2 of the headlap region 28 may be larger or smaller than the height H3 of the prime region 30.

The illustrated headlap region 28 includes three tab portions 36 separated by cutouts or notches 38. Each notch 38 has a width W1 of about 1.0 inches (2.54 cm) and a height H4 of about 4.25 inches (10.80 cm). Alternatively, the notch 38 may have a width W1 within the range of from about 0.5 inches (1.27 cm) to about 2.0 inches (5.08 cm), and a height H4 within the range of from about 3.0 inches (7.62 cm) to about 6.0 inches (15.24 cm). Alternatively, the headlap region 28 may include two tab portions 36 or four or more tab portions 36.

Figure 4:
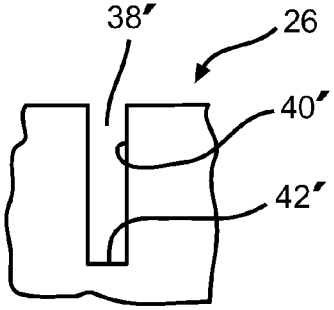
FIG. 4 is an enlarged plan view of an alternate embodiment of the notch illustrated in FIG. 3.

The notches 38 extend transversely from a trailing edge 26T of the shingle blank 26 and include substantially parallel side walls 40 and an end wall 42. In the illustrated embodiment, the end wall 42 is formed as a semi-circular surface. Alternatively, the notch may have other suitable shapes, such as shown at 38' in FIG. 4. The notch 38' includes substantially parallel side walls 40' and an end wall 42'. In the illustrated embodiment, the end wall 42' is substantially straight and extends longitudinally between, and substantially perpendicular to the side walls 40'.

Figure 5:
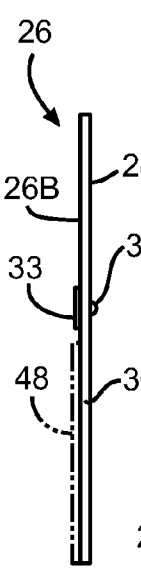
FIG. 5 is a side elevational view of the shingle blank illustrated in FIG. 3.

As illustrated by the phantom line 48 in FIG. 5, a web may be bonded to a back side 26B of the prime region 30. As described in U.S. Pat. No. 6,709,994, the web 48 may be bonded to the shingle blank 26 to provide enhanced impact resistance.

Referring again to FIG. 3, perforated cut lines 44 extend transversely from the end wall 42 of each notch 38 and include perforations 46. In the illustrated embodiment, the perforations 46 extend through entire thickness of the shingle blank 26, including a portion of the headlap region 28, the prime region 30 and the web 48, if provided.

The perforations 46 may be arranged in any suitable pattern to form the perforated cut line 44. In one embodiment of a perforation pattern of the perforated cut line 44, the perforations 46 may be about 0.25 inches (0.64 cm) long and spaced apart from end to end by about 0.25 inches (0.64 cm). In another embodiment of a perforation pattern, the perforations 46 may be about 0.50 inches (1.27 cm) long and spaced apart from end to end about 0.50 inches (1.27 cm). Alternatively, the perforations 46 may have any desired length and may be spaced apart end to end by any desired length. The perforations 46 may be configured such that an installer is able to separate the shingle blanks 26 into the hip and ridge roofing shingles 34 at the installation site. It will be understood that if desired, the notch 38 may be defined by perforated cut lines and the cut line 44 may be defined by a continuous cut line.

The illustrated shingle blank 26 includes three hip and ridge roofing shingles 34. Alternatively, the shingle blank 26 may be configured to be separated into two hip and ridge roofing shingles or more than three hip and ridge roofing shingles.

As described above, the notches 38 are formed in the headlap region 28. Outside vertical edges 26E of the shingle blank 26 include a notch 39. In the illustrated embodiment, the notch 39 has a size substantially equal to about one half of the notch 38. When the shingle blank 26 is separated into the hip and ridge roofing shingles 34, each hip and ridge roofing shingle 34 includes a notch 39 on each vertical edge 26E, as best shown in FIGS. 2 and 3. The notches 38 and 39 provide the advantage that the portion of the edge 26E of the shingle blank 26 that is defined by the notch 39 is not visible when installed on a roof as shown in FIG. 2.

Figure 6:
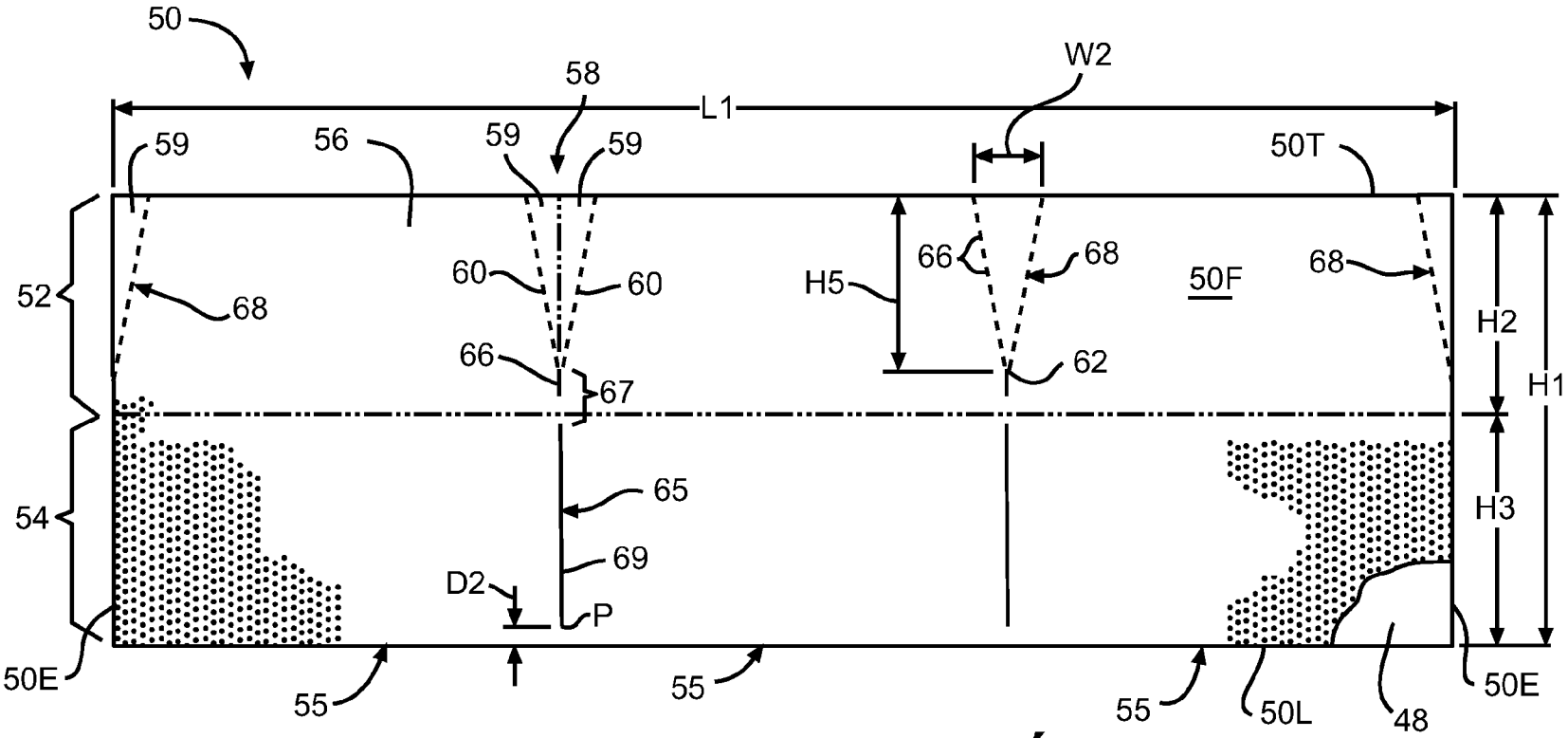
FIG. 6 is a top plan view of a second embodiment of a shingle blank in accordance with this invention.

FIG. 6 illustrates a second embodiment of the shingle blank, indicated generally at 50 from which multiple hip and ridge roofing shingles 55 may be separated by perforations and/or cuts. The illustrated shingle blank 50 includes a headlap region 52 and a prime region 54. A bead of tab sealant (not shown) may extend longitudinally on the front side 50F or the back side (not shown) of the shingle blank 50, as discussed above.

The shingle blank 50 may have any suitable dimensions. The shingle blank 50 may also be divided between the headlap region 52 and the prime region 54 in any suitable proportion. For example, illustrated shingle blank 50 has a length L1 of about 36 inches (91.5 cm) and a height H1 of about 12 inches (30.5 cm). Alternatively, the shingle blank 50 may have a length L1 within the range of from about 24.0 inches (60.96 cm) to about 39⅜ inches (100.01 cm), and a height H1 within the range of from about 7.0 inches (17.78 cm) to about 14.0 inches (35.56 cm). The height H1 dimension is divided between the height H2 of the headlap region 52 and the height H3 of the prime region 54. In the illustrated embodiment, the height H2 of the headlap region 52 and the height H3 of the prime region 54 are both about 6.0 inches (15.24 cm). Alternatively, the height H2 of the headlap region 52 may be larger or smaller than the height H3 of the prime region 54.

The headlap region 52 includes three tab portions 56 separated by cutouts or notches 58. The illustrated notches 58 are substantially triangular and include substantially straight, non-parallel side walls 60 extending from a trailing edge 50T of the shingle blank 50 and converging at an apex 62. Each notch 58 has a width W2 at its base of about 1.0 inches (2.54 cm) and a height H5 of about 4.25 inches (10.8 cm). Alternatively, the notch 38 may have a base width W2 within the range of from 0.5 inches (1.27 cm) to about 2.0 inches (5.08 cm), and a height H5 within the range of from about 3.0 inches (7.62 cm) to about 6.0 inches (15.24 cm).

Outside vertical edges 50E of the shingle blank 50 include a notch 59. In the illustrated embodiment, the notch 59 has a size substantially equal to about one half of the notch 58. When the shingle blank 50 is separated into the hip and ridge roofing shingles 55, each hip and ridge roofing shingle 55 includes a notch 59 on each vertical edge 50E, as best shown in FIG. 6. The notches 58 and 59 provide the advantage that the portion of the edge 50E of the shingle blank 50 that is defined by the notch 59 is not visible when installed on a roof.

Figure 7:
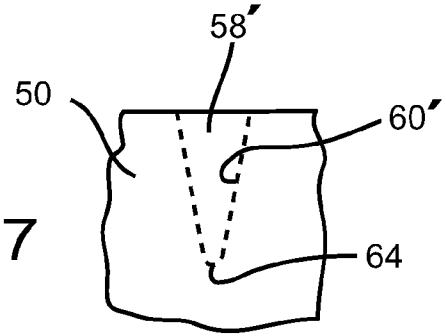
FIG. 7 is an enlarged plan view of an alternate embodiment of the notch illustrated in FIG. 7.

Alternatively, the notches 58 may have other suitable shapes, such as shown at 58' in FIG. 7. The notch 58' includes angled side walls 60' and an end wall 64. In the illustrated embodiment, the end wall 64 has a rounded shape.

As described and illustrated above, the web 48 may be bonded to a back side 50B of the prime region 54. Referring again to FIG. 6, the notch 58 is formed by perforations 66 which define perforated cut lines 68. In the illustrated embodiment, the perforations 66 extend through the entire thickness of the headlap region 52 of the shingle blank 50. Prior to installation on a roof, the substantially triangular pieces or portions of shingle blank material defined by the perforated cut lines 68 and defined by the perforated cut lines 68 and the edges 50E of the shingle blank 50 may be separated from the shingle blank 50 and discarded.

The shingle blank 50 further includes a plurality of substantially straight cut lines 65. Each illustrated cut line 65 is substantially perpendicular to the length L of the shingle blank 50 and extends from a point P to the apex 62 of a notch 58. The point P is located a distance D2 from the leading edge SOL of the shingle blank 50. In the illustrated embodiment, the distance D2 is about 0.25 inches (0.6 cm). Alternatively, the distance D2 may be any desired distance such as within the range of from about 0.0 inches (0.0 cm) to about 1.0 inches (2.54 cm).

The cut lines 65 include a perforated portion 67 and a continuous cut portion 69. The perforated portions 67 of the cut lines 65 include perforations 66. The cut lines 65 are positioned such that subsequent separation of the shingle blank 50 along the cut lines 65 forms the hip and ridge roofing shingles 55. In the illustrated embodiment, the perforated portion 67 has a length of about 0.5 inches (1.27 cm). Alternatively, the perforated portion 67 has a length within the range of from about 0.25 inches (0.6 cm) to about 1.0 inches (2.54 cm). As used herein, the term "continuous cut" is defined as a portion of the cut line wherein the cut extends through the entire thickness of all layers of a shingle blank for the length of the continuous cut portion.

The perforations 66 may be arranged in any suitable pattern, as described in detail above. The illustrated shingle blank 50 includes three hip and ridge roofing shingles 55. Alternatively, the shingle blank 50 may be configured to be separated into two hip and ridge roofing shingles or more than three hip and ridge roofing shingles.

Figure 8:
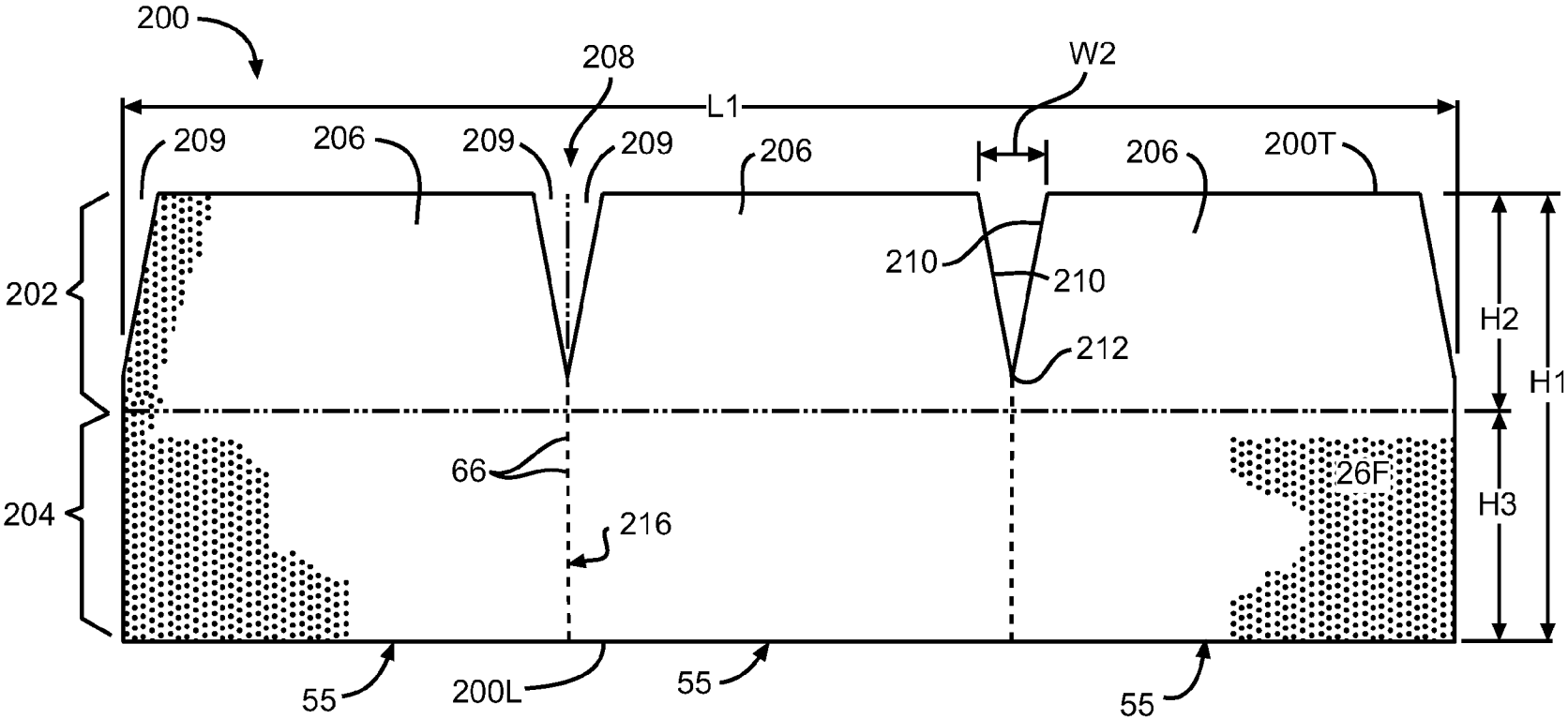
FIG. 8 is a top plan view of a third embodiment of a shingle blank in accordance with this invention.

FIG. 8 illustrates a third embodiment of the shingle blank, indicated generally at 200. The shingle blank 200 is similar to the shingle blank 50 shown in FIG. 6 in that the three hip and ridge roofing shingles 55 are formed from the shingle blank 200. The illustrated shingle blank 200 includes a headlap region 202 and a prime region 204. A bead of tab sealant (not shown) may extend longitudinally on the front side 200F or the back side (not shown) of the shingle blank 200, as discussed above. The shingle blank 200 may have any suitable dimensions, including any of the dimensions described above regarding the shingle blank 50.

Figure 9:
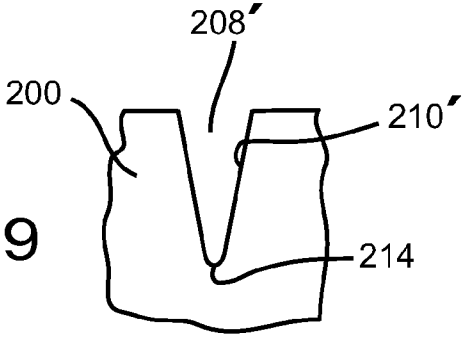
FIG. 9 is an enlarged plan view of an alternate embodiment of the notch illustrated in FIG. 8.

The headlap region 202 includes three tab portions 206 separated by cutouts or notches 208. The illustrated notches 208 are substantially triangular and include side walls 210 extending from a trailing edge 200T of the shingle blank 200 and converging at an apex 212. Each notch 208 has a width W2 at its base, as described above regarding the shingle blank 50. Alternatively, the notches 208 may have other suitable shapes, such as shown at 208' in FIG. 9. The notch 208' includes angled side walls 210' and an end wall 214. In the illustrated embodiment, the end wall 214 is formed as a rounded.

Outside vertical edges 200E of the shingle blank 200 include a notch 209. In the illustrated embodiment, the notch 209 has a size substantially equal to about one half of the notch 208. When the shingle blank 200 is separated into the hip and ridge roofing shingles 55, each hip and ridge roofing shingle 55 includes a notch 209 on each vertical edge 200E, as best shown in FIG. 8. The notches 208 and 209 provide the advantage that the portion of the edge 200E of the shingle blank 200 that is defined by the notch 209 is not visible when installed on a roof.

As described and illustrated above, the web 48 may be bonded to a back side (not shown) of the prime region 204. The shingle blank 200 further includes a plurality of substantially straight cut lines 216. Each illustrated cut line 216 is substantially perpendicular to the length L of the shingle blank 200 and extends from the leading edge 200L of the shingle blank 200 to the apex 212 of a notch 208.

In the illustrated embodiment, the cut lines 216 are perforated and include perforations 66. The cut lines 216 are positioned such that subsequent separation of the shingle blank 200 along the cut lines 216 forms the hip and ridge roofing shingles 55.

The perforations 66 may be arranged in any suitable pattern, as described in detail above. The illustrated shingle blank 200 includes three hip and ridge roofing shingles 55. Alternatively, the shingle blank 200 may be configured to be separated into two hip and ridge roofing shingles or more than three hip and ridge roofing shingles.

It will be understood that the various embodiments of cut lines described and illustrated above, including the perforations, perforated cut lines, perforated portions, continuous cuts, and continuous cut portions may be alternatively formed as deep depressions and/or indentations that may not extend through the entire thickness of all layers of the shingle blanks 26, 50, and 200. It will be further understood that these deep depressions and/or indentations will be formed having any suitable depth deep enough such that an installer is able to separate the shingle blanks 26, 50, and 200 into the hip and ridge roofing shingles 34 and 55 at the installation site.

Figure 10:
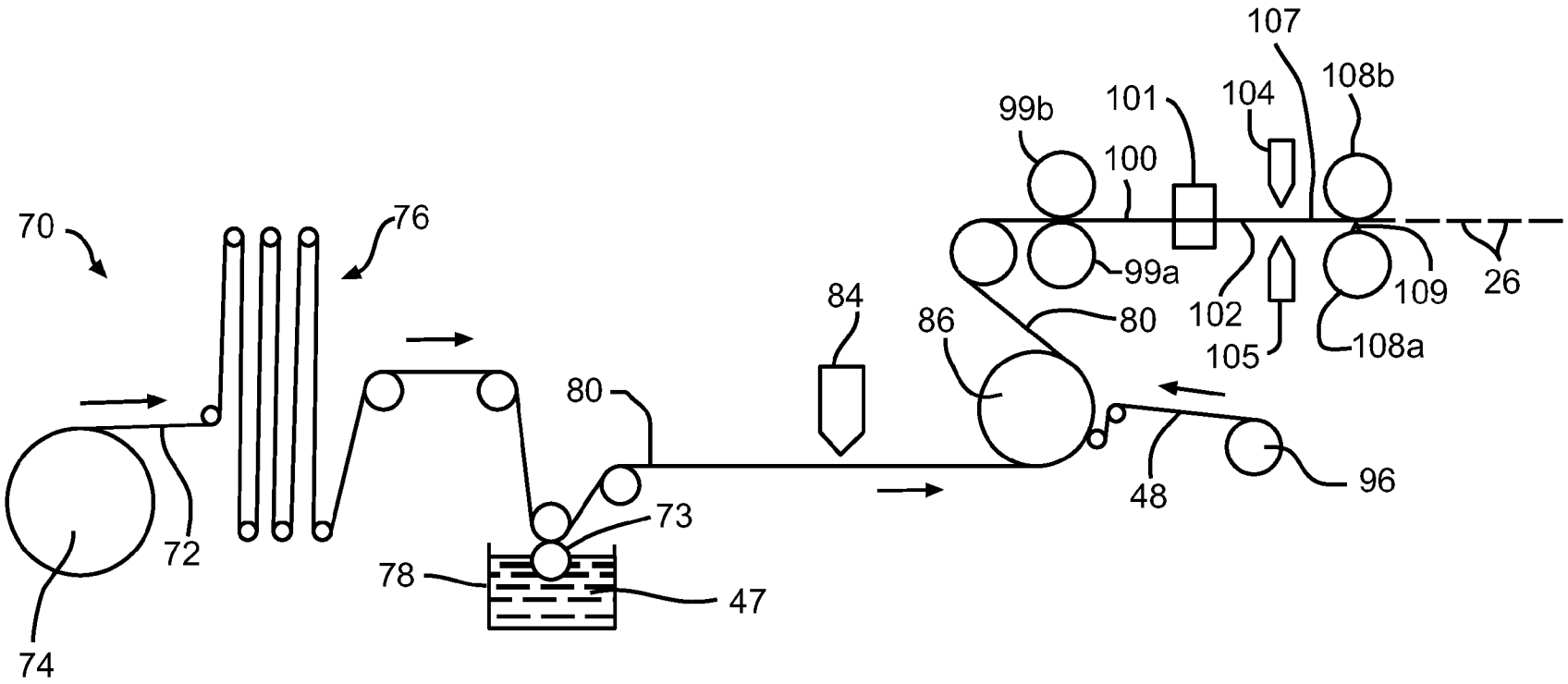
FIG. 10 is a schematic view in elevation of an apparatus for manufacturing asphalt-based hip and ridge roofing shingles in accordance with this invention.

One embodiment of the process and apparatus to manufacture the shingle blank 26 is described in U.S. Pat. No. 6,709,994 to Miller et al., and is only summarized herein. Referring now to FIG. 10, there is shown an apparatus 70 for manufacturing perforated shingle blanks according to the invention. The illustrated manufacturing process involves passing a continuous sheet 72 in a machine direction (indicated by the arrows) through a series of manufacturing operations. In one embodiment, the sheet 72 typically moves at a speed of at least about 200 feet/minute (61 meters/minute) or 300 feet/minute (91 meters/minute), and in another embodiment, typically at a speed within the range of between about 450 feet/minute (137 meters/minute) and about 800 feet/minute (244 meters/minute). Although the invention is shown and described in terms of a continuous process, it will be understood that the invention may also be practiced in a batch process using discreet lengths of materials instead of continuous sheets.

In a first step of the manufacturing process, the continuous sheet 72 of substrate is payed out from a roll 74. The substrate may be any type known for use in reinforcing asphalt-based roofing materials, such as a nonwoven web, scrim, or felt of fibrous materials, such as glass fibers, mineral fibers, cellulose fibers, rag fibers, mixtures of mineral and synthetic fibers, or the like. Combinations of materials may also be used in the substrate. The sheet 72 of substrate is passed from the roll 74 through an accumulator 76. The accumulator 76 allows time for splicing one roll of substrate to another, during which time the substrate within the accumulator 76 is fed to the manufacturing process so that the splicing does not interrupt manufacturing.

Next, the sheet 72 is passed through a coater 78 where an asphalt coating 47 is applied to the sheet 72 to completely cover the sheet 72 with a tacky coating. The asphalt coating 47 may be applied in any suitable manner. In the illustrated embodiment, the sheet 72 contacts a roller 73, that is in contact with a supply of hot, melted asphalt. The roller 73 completely covers the sheet 72 with a tacky coating of hot, melted asphalt to define an asphalt coated sheet 80. In other embodiments, however, the asphalt coating could be sprayed on, rolled on, or applied to the sheet 72 by other means.

As used herein, the term "asphalt coating" is defined as any type of bituminous material suitable for use on a roofing material such as asphalts, tars, pitches, or mixtures thereof. The asphalt may be either manufactured asphalt produced by refining petroleum or naturally occurring asphalt. The asphalt coating 47 may include various additives and/or modifiers, such as inorganic filters, mineral stabilizers, or organic materials, such as polymers, recycled streams, or ground tire rubber.

As further shown in FIG. 10, the asphalt-coated sheet 80 is then passed beneath a granule dispenser 84 for the application of granules (not shown). While the embodiment shown in FIG. 10 illustrates a single granule dispenser 84, it will be appreciated than any number of granule dispensers 84 may be used. After deposit of the granules, the asphalt-coated sheet 80 is turned around a slate drum 86 to press the granules into the asphalt coating 47 and to temporarily invert the asphalt-coated sheet 80.

Referring again to FIG. 10, the roofing material; i.e., the shingle blank 26, may also include the web 48. It will be understood however, that the web 48 is not required. The web 48 is selected for the type of roofing material and is positioned and bonded in such a manner as to provide the roofing material with improved impact resistance to a variety of impacts. As shown in FIG. 10, the web 48 may be payed out from a roll 96 onto the lower surface of the asphalt-coated sheet 80 while the asphalt-coated sheet 80 is inverted on the slate drum 86. As the asphalt-coated sheet 80 turns around the slate drum 86, the asphalt coating 47 is still hot, soft, and tacky, so that the web 48 adheres to the lower surface of the asphalt coating 47 and is pulled around the slate drum 86 along with the asphalt-coated sheet 80. The web 48 may be applied to the lower surface of the asphalt-coated sheet 80 in the prime portions 30, but not in the headlap portions 28.

Application of the web 48 beneath just the prime portion 30 of a roofing material provides improved impact resistance to the portion of the roofing material exposed to the elements on a roof, while minimizing the overall cost of the roofing material. While the embodiment shown in FIG. 10 illustrates one method of applying a web to the roofing material, it will be understood that other suitable bonding methods, such as for example heat sealing, ultrasonic welding, pressure sensitive or hot melt adhesive, electrostatic bonding, and physical intertwining by such means as needling or stitching, may be used. Bonding the web 48 to the asphalt-coated sheet 80 forms webbed sheet (not shown). In an embodiment wherein a web 48 is bonded to the asphalt-coated sheet 80 to form a webbed sheet, the webbed sheet may be pressed and cut as described below regarding the asphalt-coated sheet 80.

In the illustrated embodiment, the asphalt-coated sheet 80 is passed between backing roller 99*a* and press roller 99*b*. The rollers, 99*a* and 99*b*, are configured to compress the asphalt-coated sheet 80 with sufficient pressure to embed the granules into the asphalt-coated sheet 80. Passing the asphalt-coated sheet 80 through the backing roller 99*a* and the press roller 99*b* forms the embedded sheet 100.

Referring again to FIG. 10, after the embedded sheet 100 is formed by the backing roller 99*a* and the press roller 99*b*; the embedded sheet 100 is cooled by any suitable cooling apparatus 101, or allowed to cool at ambient temperature to form a cooled sheet 102.

If desired, the cooled sheet 102 may be passed through applicators 104 and 105. The applicators 104 and 105 are configured to apply a sealant to the surfaces of the cooled sheet 102. The applicators 104 and 105 may be any suitable mechanism or device for applying the sealant to the cooled sheet 102. In the illustrated embodiment, the applicator 104 applies the sealant to the top surface of the cooled sheet 102 and the applicator 105 applies the sealant to the bottom surface of the cooled sheet 102. In other embodiments, the sealant may be applied to just the top or bottom surfaces of the cooled sheet 102. Application of the sealant to the cooled sheet 102 forms sealed sheet 107.

The sealed sheet 107 is then passed through cutting roller 108*a* and anvil roller 108*b*. In the illustrated embodiment the rollers, 108*a* and 108*b*, are configured to perform several manufacturing operations. The cutting roller 108*a* and the anvil roller 108*b* are configured to form the perforated cut lines 44 and 68 and the cut lines 65. As discussed above, the perforated cut lines 44 and 68 and the cut lines 65 may be positioned anywhere along the length L of the shingle blank 26. The cutting roller 108*a* includes a plurality of knife blades 109 spaced apart and extending radially outwardly from a surface of the cutting roller 108*a*. The knife blades 109 rotate with the rotation of the cutting roller 108*a* and form the continuous cut portion 64 and the perforated portion 62 of the cut lines 60 upon contact with the sealed sheet 107. The cutting roller 108*a* and the anvil roller 108*b* may also be configured to cut the sealed sheet 107 to form individual hip and ridge roofing shingles 34 and/or individual shingle blanks 26.

Once formed and cut the shingle blanks 26 may be collected and packaged. While FIG. 10 illustrates one example of an apparatus configured for forming the perforated cut lines 44 and 68 and the cut lines 65, it will be understood that other suitable apparatus or combinations of apparatus may be used.

While the embodiment shown in FIG. 10 illustrates forming the perforated cut lines 44 and 68 and the cut lines 65 and cutting the sealed sheet 107 into individual shingle blanks 26 as a single process, it is within the contemplation of this invention that the step of forming the perforated cut lines 44 and 68 and the cut lines 65 and the step of cutting the sealed sheet 107 into individual shingle blanks 26 may be completed at different times and by different apparatus.

It will be understood that the cut shingle blanks 26 arrive at an installation site having the perforated cut lines 44 and 68 and the cut lines 65 formed therein. During installation, the roofing installer cuts or tears the cut shingle blank 26 along the perforated cut lines 44 and 68 and the cut lines 65 to form hip and ridge roofing shingles 34. The perforated cut lines 44 and 68 and the cut lines 65 allow for hip and ridge roofing shingles 34 to be formed from the cut shingle blanks 26 as the perforated cut lines 44 and 68 and the cut lines 65 allow the shingle blanks 26 to be easily cut or torn.

Further, the shingle blanks are shown being cut from a lower surface (opposite the granule-coated surface) toward the granule-coated surface of each shingle blank. It will be understood that the shingle blanks may also be cut from the granule-coated surface toward the lower surface of each shingle blank.

The present invention should not be considered limited to the specific examples described herein, but rather should be understood to cover all aspects of the invention. Various modifications, equivalent processes, as well as numerous structures and devices to which the present invention may be applicable will be readily apparent to those of skill in the art. Those skilled in the art will understand that various changes may be made without departing from the scope of the invention, which is not to be considered limited to what is described in the specification.

What is claimed is:

1. A single shingle layer shingle blank comprising:

a single shingle layer comprising a substrate coated with asphalt, the single shingle layer comprising a longitudinally extending prime region and a longitudinally extending headlap region;

a pair of outside shingle blank edges;

an outside shingle blank edge notch formed only in the headlap region of each of the pair of outside shingle blank edges;

first cut lines defining a pair of inner notches only in the headlap region of the substrate of the shingle blank between the pair of outside shingle blank edge notches;

a second cut line extending from each of the pair of inner notches toward a leading edge of the shingle blank;

wherein the first cut lines are perforated and are structured and configured to facilitate separation of the shingles of the shingle blank material such that when the portion of shingle blank material is separated and removed, the first cut lines define the pair of inner notches;

wherein the at least one of the first cut lines and the second cut lines are structured and configured to maintain the shingle blank as a unitary shingle blank until the shingle blank is selectively separated into discrete single shingle layer shingles by separating the shingle blank at the location of at least one of the first cut lines and the second cut lines, each discrete single shingle layer shingle having a single shingle layer comprising a substrate coated with asphalt, the single shingle layer of each discrete single shingle layer shingle having a prime region, a headlap region and a pair of outside shingle edges;

wherein the pair of inner notches and pair of outside shingle blank edge notches are structured and configured so that a notch portion is formed in both outside shingle edges of each discrete shingle only in the headlap region once the shingle blank has been separated into discrete shingles; and wherein in an installed state the headlap region of the shingles is substantially covered by an overlapping shingle.

2. The shingle blank according to claim 1, wherein the first cut lines include substantially straight, parallel side walls extending from a trailing edge of the shingle blank and a substantially straight end wall extending transversely to the side walls.

3. The shingle blank according to claim 1, wherein the first cut lines include substantially straight, parallel side walls extending from a trailing edge of the shingle blank and a rounded end wall.

4. The shingle blank according to claim 1, wherein the first cut lines include non-parallel side walls extending from a trailing edge of the shingle blank and converging at an apex.

5. The shingle blank according to claim 1, wherein the second cut line is a continuous cut line.

6. The shingle blank according to claim 1, wherein the second cut line includes a perforated cut portion and a continuous cut portion.

7. The shingle blank according to claim 1, wherein the pair of inner notches each have a width at a base of the inner notch within the range of about 0.5 inches to about 2.0 inches.

8. The shingle blank according to claim 7, wherein each of the outside shingle blank edge notches has a width substantially equal to about one half of the width of an inner notch.

9. A single shingle layer shingle blank comprising:

a single shingle layer comprising a substrate coated with asphalt, the single shingle layer comprising a longitudinally extending prime region and a longitudinally extending headlap region;

a pair of outside shingle blank edges;

an outside shingle blank edge notch formed only in the headlap region of each of the pair of outside shingle blank edges;

a pair of substantially V-shaped perforated cut lines formed only in the headlap region of the substrate of the shingle blank defining a pair of removable triangular pieces between the pair of outside shingle blank edge notches;

at least one substantially straight cut line extending from an apex of each of the pair of V-shaped perforated lines toward a leading edge of the shingle blank;

wherein the pair of substantially V-shaped perforated cut lines are structured and configured to maintain the shingle blank as a substantially unitary shingle blank until the shingle blank is selectively separated into discrete single shingle layer shingles by separating the shingle blank at the location of at least one of the V-shaped perforated cut lines and at least one of the substantially straight cut lines and removing at least one of the triangular pieces, each discrete single shingle layer shingle having a single shingle layer comprising a substrate coated with asphalt, the single shingle layer of each discrete single shingle layer shingle having a prime region, a headlap region and a pair of outside shingle edges;

wherein the pair of substantially V-shaped perforated cut lines and pair of outside shingle blank edge notches are structured and configured so that a notch is formed in both outside shingle edges of each discrete shingle only in the headlap region once the shingle blank has been separated into discrete shingles; and wherein in an installed state the headlap region of the shingles is substantially covered by an overlapping shingle.

10. The shingle blank according to claim 9, wherein the at least one substantially straight cut line is one of a perforated cut line and a continuous cut line.

11. The shingle blank according to claim 9, wherein the at least one substantially straight cut line includes a perforated cut portion and a continuous cut portion.

12. The shingle blank according to claim 9, wherein the discrete shingles are hip and ridge roofing shingles.

13. The shingle blank according to claim 9, wherein the at least one substantially straight cut line is formed in the prime region.

14. The shingle blank according to claim 9, wherein the removable triangular pieces each have a width at a base of within the range of about 0.5 inches to about 2.0 inches.

15. The shingle blank according to claim 14, wherein each of the outside shingle blank edge notches has a width substantially equal to about one half of the width of the removable triangular piece.

* * * * *